US006674367B2

(12) United States Patent
Sweatte

(10) Patent No.: US 6,674,367 B2
(45) **Date of Patent: *Jan. 6, 2004**

(54) METHOD AND SYSTEM FOR AIRPORT AND BUILDING SECURITY

(76) Inventor: Clifford Sweatte, 20296 Watermill Rd., Purcellville, VA (US) 20132

( * ) Notice: Subject to any disclaimer, the term of this patent is extended or adjusted under 35 U.S.C. 154(b) by 0 days.

This patent is subject to a terminal disclaimer.

(21) Appl. No.: 10/023,421

(22) Filed: Dec. 17, 2001

(65) Prior Publication Data

US 2003/0214407 A1 Nov. 20, 2003

Related U.S. Application Data

(63) Continuation-in-part of application No. 09/669,417, filed on Sep. 25, 2000, now Pat. No. 6,335,688.
(60) Provisional application No. 60/156,447, filed on Sep. 28, 1999.

(51) Int. Cl.[7] ..... G08B 23/00
(52) U.S. Cl. ..... 340/573.1; 340/539; 340/506
(58) Field of Search ..... 340/573.1, 539, 340/506, 573.4, 10.42, 10.6; 455/88, 100; 235/384

(56) References Cited

U.S. PATENT DOCUMENTS

| | | | | |
|---|---|---|---|---|
| 5,914,671 A | | 6/1999 | Tuttle | 340/825.51 |
| 5,982,281 A | | 11/1999 | Layson | 340/539 |
| 6,085,976 A | | 7/2000 | Sehr | 235/384 |
| 6,127,917 A | | 10/2000 | Tuttle | 340/10.1 |
| 6,229,445 B1 | | 5/2001 | Wack | 340/572.1 |
| 6,246,320 B1 | | 6/2001 | Monroe | 340/506 |
| 6,335,688 B1 | * | 1/2002 | Sweatte | 340/573.1 |

* cited by examiner

*Primary Examiner*—John Tweel
(74) *Attorney, Agent, or Firm*—Clifford Kraft

(57) ABSTRACT

A method and system for airport or other building security where passengers or persons entering a building approach a check-in point or check-in counter and must undergo a positive identification (ID) by fingerprint scan, retinal or iris scan, face feature scan, or an other means of positive identification. A digital photograph can then be taken of the person. This data plus the positive ID data and optional data about the person including a scan of a government supplied ID like a drivers license or passport is entered in a database and checked against various law enforcement databases such as FBI or others for law enforcement interest in the person. The person is given an electronic card that has wireless capability. The person carries the card while in the airport or building. The system is notified when the person enters a secure gate area, boards or leaves an aircraft, etc. In addition, the system can determine if a person is carrying more than one card or if a card has been abandoned. The system detects and tracks any undesirable person in the airport or building an provides a means for apprehending the person by security or law enforcement personnel. In addition, immigration or customs can be notified about any undesirable person arriving in an airport or building. The system can track a passenger through airports and aircraft in the world air transportation system.

22 Claims, 6 Drawing Sheets

METHOD AND SYSTEM FOR AIRPORT AND BUILDING SECURITY

This is a continuation-in-part of application Ser. No. 09/669,417 filed Sep. 25, 2000, now U.S. Pat. No. 6,335,688. This application also claims priority from U.S. provisional application No. 60/156,447 filed Sep. 28, 1999 and hereby incorporates that application by reference.

BACKGROUND

1. Field of the Invention

This invention relates generally to airport security and in particular to a method and system for identifying and tracking a person, passenger, or employee in and through any building and in particular from and through airports and aircraft in the world air transportation system.

2. Description of Related Art

An identification badge is many times provided to employees of buildings or airports. Passengers in airports and visitors to buildings however are identified only by a single photo identification that is presented at check-in, or sometimes not at all in the case of buildings. Security consists of a series of questions concerning baggage and tickets. No check is made on the identity of the passenger except to ask for a government issued piece of ID like a driver's license or passport. There is no cross-checking as to whether the presented ID is valid or fraudulent The passenger's location in the airport is not known or tracked. When the passenger checks into a flight, a boarding pass is presented and the passenger boards the aircraft. There is no verification that the same passenger who checked in is the one that boarded, and it is very easy for a boarded passenger to exit the aircraft after boarding without being noticed by anyone. Security at airports is minimal as to who a passenger is and where the passenger is in the airport.

Since Sep. 11, 2001, airport security has come under tighter scrutiny; however, there is still no way to positively identify a passenger or track a passenger's movements while they are in the airport or aircraft; no way to ascertain when they have passed through security or whether they have exited a secure area without boarding a plane; no way to prevent or detect someone passing through security more than once, and no way to be sure the person on the plane is the same person who passed through the security checkpoint and/or was issued a boarding pass. In the case of buildings, the situation is worse. In this case, once a visitor is admitted to the building, usually, but not always, by signing in, the visitor is usually free to wander anywhere on any floor. A skilled terrorist could easily gain access to a roof, basement, or mechanical room area without being detected.

Prior art airport systems have proposed electronic tickets and smartcards that can be carried by passengers. Tuttle in U.S. Pat. No. 5,914,671 presents a system for locating an individual in a facility where a portable wireless transponder device is carried by the individual. Tuttle's device resembles a standard security badge with a possible photo of the individual on the badge. Tuttle's invention is directed toward location of employees who would wear such badges. Tuttle states that a passenger could also possess such an identification and be located. However, Tuttle's patent was developed with the idea that a business traveler would not want to stand in line for a ticket, much less for an electronic interrogation, and mentions the use of curb-side baggage check-in. His method terminates once a passenger or bag enters an aircraft. He makes no reference to any type of security checking of the individual.

Yokozawa et al. in U.S. Pat. No. 5,740,369 present an information delivery system and portable information terminal where an individual possesses a smartcard type of wireless device and can be tracked by a wireless system. Yokozawa also describes a person passing through a check-in gate with the gate itself recognizing and communicating with the portable device by wireless means. While Yokozawa presents a wireless device carried by a passenger, there is no mention of the security aspects of the situation.

The prior art shows systems where passengers and/or employees carry wireless smartcards that communicate in data bases, but not via satellite or internet, and none of these systems solve, or even address, the tremendous security problem that exists at airports and other buildings where potential passengers could be terrorists, criminals or other dangerous persons. They do not address the problem of whether a passenger actually boards a flight and remains on the plane, and whether the passenger actually arrives and exits a second or subsequent airport, nor do they propose be tracked while aboard an aircraft with data transmitted ahead to connecting aircraft and/or customs/law enforcement/immigration officials. In the current airport system and prior art systems, there has historically been no connection or relationship between airline database information and security database information. Since Sep. 11, 2001, in the U.S., there has been some recent sharing of FBI information with airlines; however, this has been limited to lists of known terrorists. There has been no direct access from the airport to the law enforcement data base.

What is needed is the ability to screen passengers or visitors and move then through a terminal to their aircraft and then on to their destination, or through a building to their destination while knowing at all times who and where the passengers are.

SUMMARY OF THE INVENTION

The present invention relates to a method and system for airport or building security where a passenger or visitor presents themselves at the check-in counter or guard station in the normal way. A government generated picture identification is also presented (drivers license, passport, or government issued ID card, etc.). The present invention then requires additional positive identification by fingerprint scan, retina or iris scan, face feature scan, voice scan, handprint, palmprint, finger length comparison, DNA, or any other means of positive identification. In addition, a new photo can be taken of the passenger during check-in. The total data thus acquired can be compared against law enforcement databases such as FBI, Immigration, or INTERPOL, etc. to determine immediately if the potential passenger is wanted or known to be dangerous, and if the passenger is who he claims to be. There needs to be no indication at the check-in counter or guard station if a positive identification is made of a dangerous individual; rather, security personnel can be immediately notified.

The present invention requires check-in and a positive identification of a passenger. Fraudulent ID's and criminals can be immediately identified by law enforcement. In the case of airports, the present invention continues past boarding through the flight and customs/immigration and terminates upon exit at the passenger's destination.

After the identification process is complete, the passenger can be checked into the flight, or allowed admission to the building, and then given a wireless device that may be in the form of a smartcard or any other portable device that can be carried or worn. This device serves as a boarding pass and airport/aircraft tracking device or as a tracking device in the building. The device can be a small, flat, card like a credit card, a device like a personal digital assistant, or any other small electronic device that can contain electronics and wireless communication capabilities. Since the location of this card wireless device can be tracked in the airport or building by wireless antenna location means, by GPS, or by direction fixing between multiple antennas, or any other tracking means, the location of the person is known at all times while in any area of the airport, aircraft or building. In the case of a positive identification of a dangerous or wanted individual, law enforcement officials can apprehend the person anywhere in the airport or building that allows a safe and non-disruptive apprehension.

In the case of an airport, the system can also report when the person has passed through carry-on security (normal X-ray, etc.), or any other security check point, when the person is in the departure gate area, and when the person has boarded an aircraft. At boarding, a second security check can be made with a second fingerprint or retinal scan or any other positive identification method to verify that the person who checked in originally is the one boarding the flight. The system can positively make sure the person boards a certain aircraft and stays on since egress could be controlled by having to present the smartcard to exit.

In the rare case of someone having to legitimately leave an aircraft after boarding, airline personnel could be immediately notified by the card at egress to ascertain why the exit is being made and to be able to assist the person (who might have gotten on the wrong plane, might be sick, etc.). An illegal or unexpected egress would be immediately noted by airport security personnel. It is also possible to continue to communicate with the card inside the aircraft if the craft is also equipped with a wireless system. In addition, satellite communication can possibly be carried on with the aircraft and cards inside the aircraft while it is in flight or parked at a gate. Passenger's movements could be tracked or mapped while they are onboard the aircraft in real time. Additionally, the movement information can be saved and reviewed at a later date if a particular passenger's movements would be of interest to law enforcement officials.

Upon arrival at a final or intermediate airport, a normal egress from the aircraft could be noted by the system in the new airport. The passenger's location could be tracked by the system through customs/immigration, if an international flight, on to baggage pickup and airport exit, or until re-boarding a subsequent flight. When the passenger finally exited the final airport, the card could be collected and recycled for reuse, and the system would note that the person had left the system.

A major improvement of the invention over the prior art is the positive identification of every passenger and possibly every person entering an airport or building as well as providing positive tracking at all times as to the location of the person in the airport, building, or in the world air transportation system consisting of all participating airports and aircraft. The invention provides a final determination that an individual has arrived at a final destination and departed the system or has legitimately left the building in question.

The present invention could be optionally applied to all people in airports or any other building, including visitors, by also requiring them to register on entry, at least by fingerprint scan, and also carry a card while in the airport or building. Anyone who tried to leave an airport or building without a card could be stopped and re-identified (sometimes people might lose the card or device). A lost card could be located through wireless communication with a central control point.

A more sophisticated version of a card or electronic device could be equipped with an LED display device where flight schedules could be called up, and an alarm that would buzz or otherwise indicate the approach of boarding time. The more sophisticated card could be connected into the internet for the convenience of the passenger so that the passenger could receive or send E-mail, get stock quotes, or generally surf the internet while waiting for the flight. A buzz or audible alarm could sound if there was an important announcement coming in for that passenger such as a gate change, etc. A more sophisticated version of the card could also contain a cellphone.

The present invention increases the speed by which a traveler or person entering a secure building or airport can proceed to their destination and increases safety and security. The present invention allows a screening agency to identify legitimate passengers and cargo as legitimate and detects criminals and other dangerous persons in order to prevent terrorist and other illegal acts.

The present invention has the ability to follow a single person and bag and back-track all of his or her movements. A keystroke could bring up all persons a target came into contact with as well as trace all of his contact's movements to see if they entered the airport together, then separated and came back together again after clearing security, etc. The tracking aspect of the present invention could allow law enforcement agents to stop a potential terrorist and all those he or she came in contact with prior to boarding. This tracking aspect could also record and store a person's movement throughout the building or airport complex. Patterns of suspected terrorists or criminals could be overlaid on each other to see if their routes through a facility coincided. Similar stops could indicate drop points or pick up points.

It should be understood that the above mentioned figures are for illustration of the principles of the invention only. It would be clear to one skilled in the art that many other combinations and embodiments are within the scope of the present invention.

DETAILED DESCRIPTION

Figure 1:
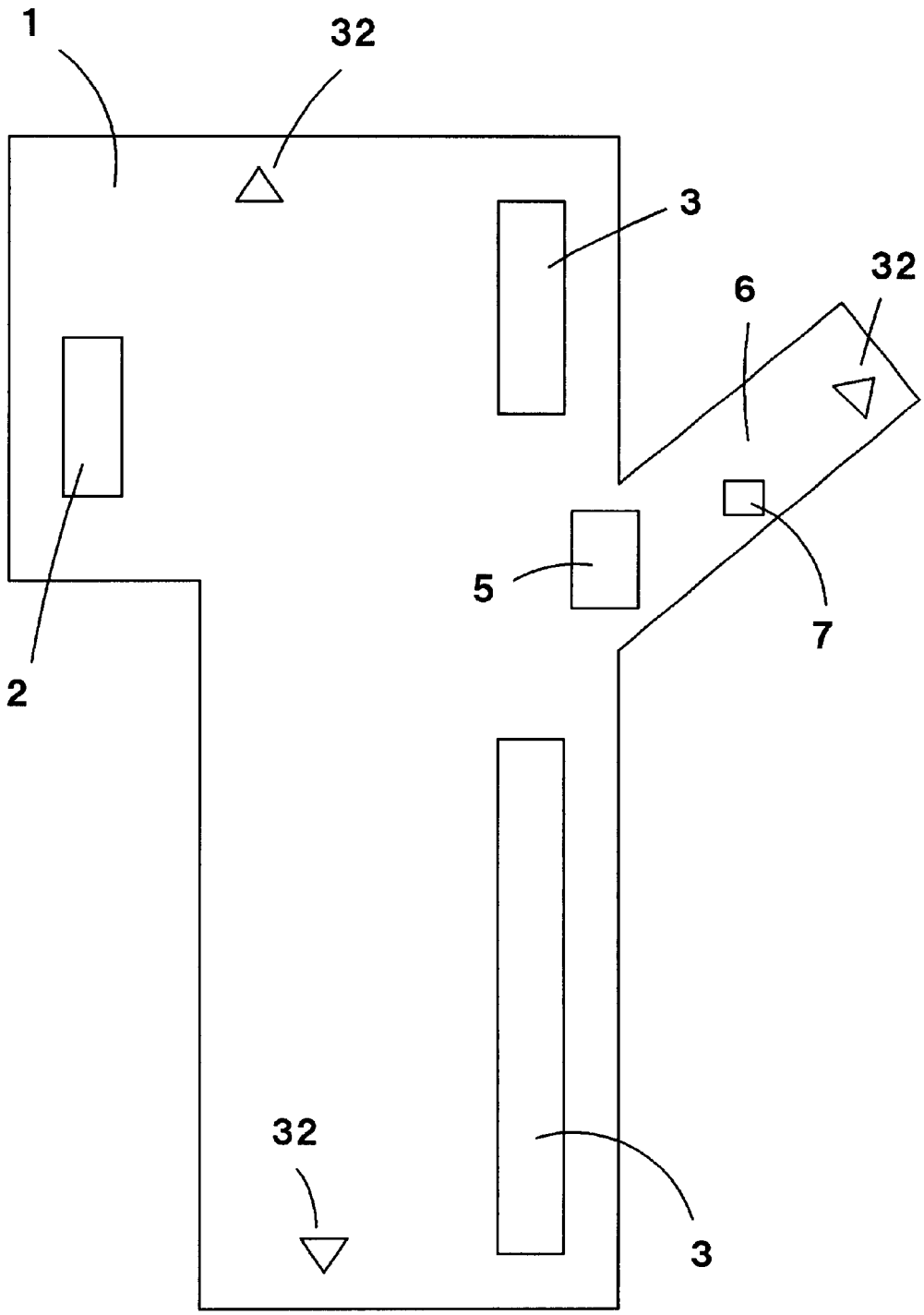
FIG. 1 shows an embodiment of the present invention as a diagram of an airport showing important points in the security scheme.

FIG. 1 shows an airport where the invention is used as a passenger or personnel security system. Most airports contain an entry area or set of doorways (1) where people enter and leave the airport complex. An optional system check-in area (2) can be set up here if it is desired to control people entering and leaving the facility. If this station is used, a person entering the airport simply allows a fingerprint, retinal scan, or other positive ID to be made at this point. People departing the airport or building would be required to turn in cards at this point in order to egress.

Most airports are constructed with an airline check-in area with long counters where passengers are checked into flights, where most commercial or government buildings have a reception desk in their entrance foyer. FIG. 1 shows several such check-in counters 3 in the case of an airport. At these counters, passengers queue up and wait to present or purchase their tickets. This particular check-in point is where most data is entered into the system of the invention. When a passenger presents a ticket to an agent at this type of checkpoint, the passenger is required to also present some sort of government issued photo identification. Usually this is a driver's license or passport. At this point, a device could scan in the photo on the presented identification. A fraudulent ID would be detected immediately. Any special information about the passenger that was needed or desired by the airline could also be entered such as medical information, special food requirements and other information as may be needed by the airline. Normal seat assignment or check can be made at this point.

Here, the passenger would be required to submit to a positive identification check. This check can be in the form of a fingerprint scan, an eye retinal or iris scan, a face scan, a hand scan, a palmprint, a hand scan, a finger length scan, DNA check or any other positive identification method. At this point, the system can take a current photo of the passenger, and can present all the data to a computer database. The data can be checked against Police, FBI, INTERPOL, immigration, customs, postal service, or other databases. If law enforcement databases are remote from the airport, the data can be transmitted by modem, LAN, WAN, internet, or any other data transmission method.

The passenger can then be handed an electronic card device and told to keep it on their person. This card can be a wireless device that can contain data and can be tracked for location throughout the airport complex (or building), and could also be used as an electronic boarding pass. The passenger would of course also be entered into the airline database in the normal way for flight check-in and possibly for aircraft weight and balance purposes. The system can contain antennas 32 for tracking the smartcard. These antennas 32 can be located in many places in the building or airport complex in question.

The passenger would then be allowed to leave the check-in counter with the card as an electronic boarding pass and tracking system. If there has been any discrepancy in the identification given by the passenger after checking the data against law enforcement databases, airport security officials can track the location of the bearer of the card anywhere in the airport. If there is sufficient cause, the passenger could be apprehended or detained at a time and place determined by law enforcement or security officials.

Airports are constructed with a baggage and carry-on security checkpoint 5 which usually contains X-ray equipment for checking carry-on bags and metal detectors (possibly explosive detectors) to check for weapons and dangerous material. With the present invention, this checkpoint 5 could also communicate by wireless means with any card nearby. As the passenger passed through this checkpoint, the system would note this progress. The card could be optionally hand read with a magnetic reader. If the passenger were to subsequently leave the secure gate area for any reason, this can be noted.

Once in the gate area 6, the passenger approaches the flight departure gate and passes another checkpoint 7. Here again the system could note the location of the passenger and the fact the he is actually boarding an aircraft. A database check can be made to assure it is the correct aircraft, and if wrong, airline personnel could be immediately notified. At this aircraft boarding checkpoint 7, a second positive identity check can be optionally performed such as taking another fingerprint, retinal or face scan, etc. While this second scan is optional, it tremendously enhances security if used because it can determine if the correct individual is boarding the aircraft.

If a passenger tries to leave an aircraft after successful boarding, the card could immediately detect this fact, and airline personnel, and if necessary security personnel, could be notified. Since there may be legitimate reasons a passenger might deplane (sickness, trying to make a phone call, simply changed mind about traveling, etc.), airline personnel should make sure at this point the reason. The difference between the present invention and the prior art is that with the present invention, the fact that the passenger has left the airplane is immediately known.

The invention could also determine if a person is carrying more than one card, or if a card has been lost. This is very useful in making sure that passengers on planes are the ones who should be there, and that passengers actually take the flight they are supposed to. If someone tries to deplane without a card in their possession an alarm could be set off, or security personnel could be notified. This is easily accomplished since there could be an alarm at the plane entry and exit point 7 that detects anyone trying to pass through. A quick interrogation of the person's card could prevent the actual ringing of an alarm while still alerting airline personnel.

Figure 2:
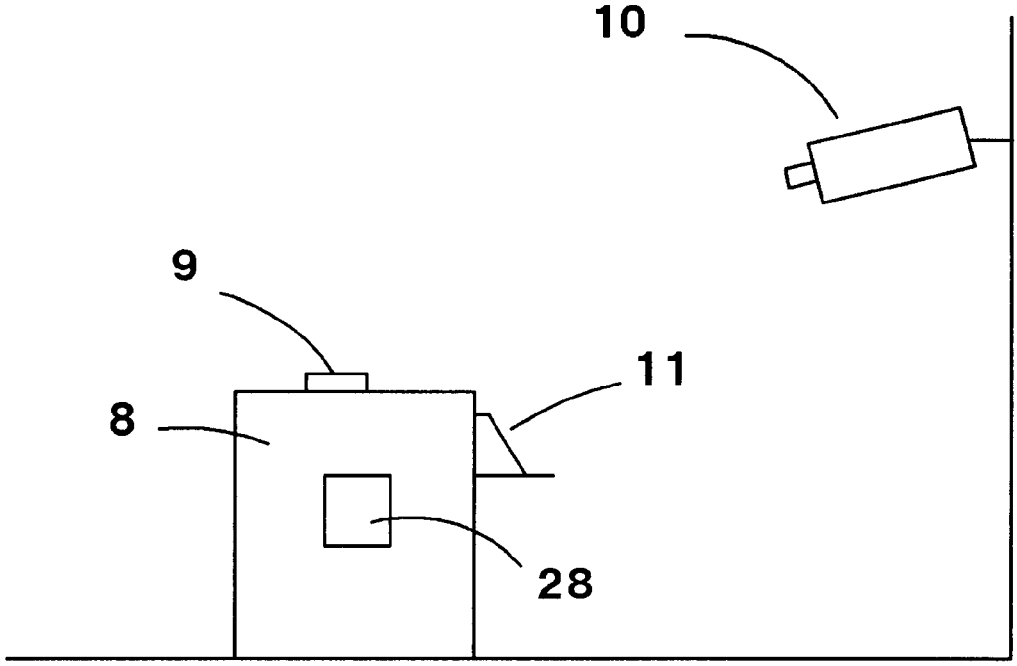
FIG. 2 shows an airport check-in arrangement.

FIG. 2 shows a side view of an airline check-in station using the invention. There can be the counter 8 commonly found at airports with some means for checking in baggage (not shown) and for assigning or checking seating. There can also be a standard computer terminal 11; however this terminal can connect to the card system software of the invention which prompts the operator for specific information required to be entered as well as optional information. In addition, this terminal 11 can allow normal entry of airline passenger check-in data.

The check-in station can contain a positive identification device 9 which can be a fingerprint scanner, an eye retinal or iris scanner, a face pattern or feature scanner, DNA analyzer, hand scanner, palmprint scanner, finger length scanner, or any other means that may exist now or in the future for positive identification of an individual. The station can also be equipped with a camera 10 which can be a digital still photo camera, a TV camera, or any other type of camera or image generation device. The station can also contain a document scanner 28 for scanning in the identification presented by the passenger.

During check in, the passenger would approach the check-in station counter 8 in the normal way. A government generated, photo identification such as a drivers license or passport would be presented by the passenger and scanned using the scanning device 28 provided in the station. A digital photo could be taken with the camera 10, and a positive identification could be made with a positive identification device 9.

After this data is taken, it would be entered into the database of the system. From here it could be transmitted or compared against law enforcement, immigration, or customs information to determine if the individual is wanted, or is a threat in any way, or if there is any other law enforcement interest. After normal airline check-in, the passenger would be presented with a wireless card to carry. This card would be equipped with a transponder so that it could be tracked and located anywhere in the airport or building complex.

Figure 3:
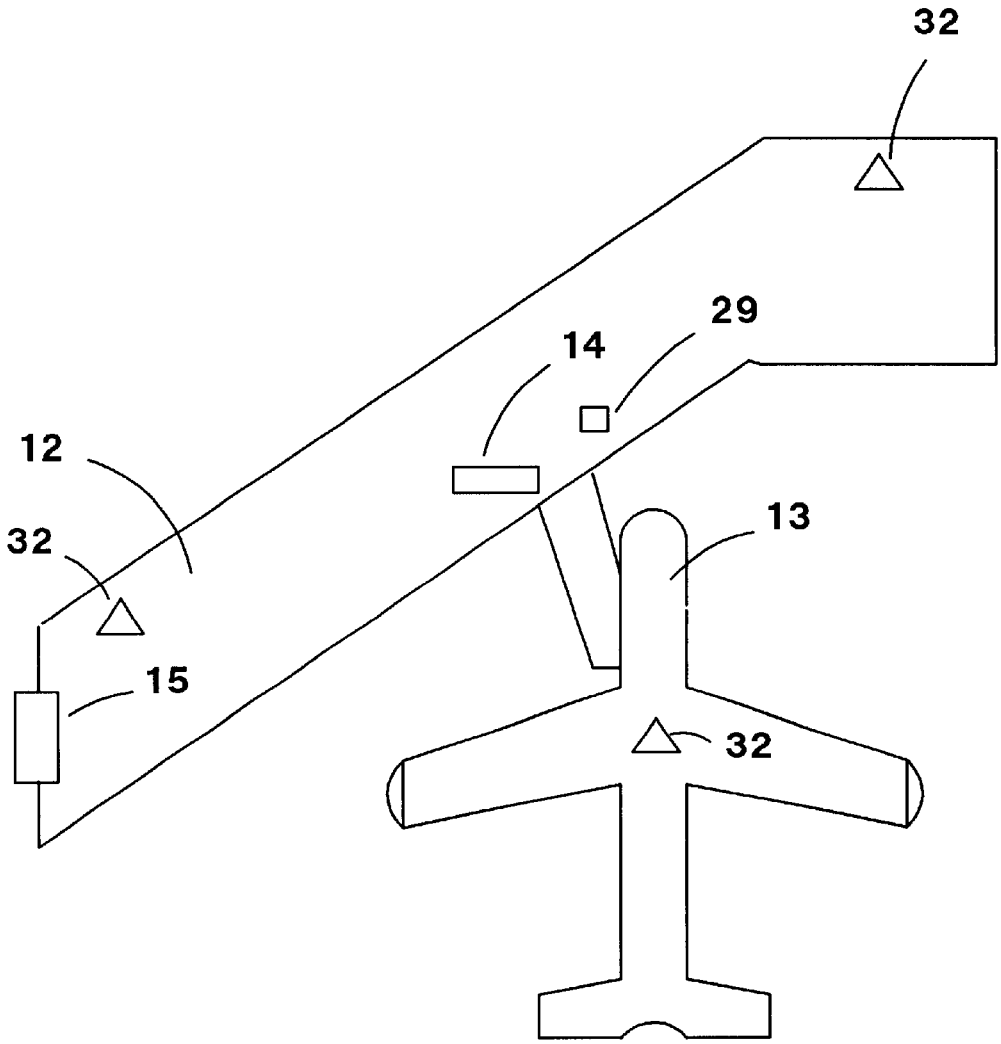
FIG. 3 shows a aircraft boarding gate with egress control.

FIG. 3 shows a typical airport gate area. There is an entrance security port 15 which contains standard carry-on and personal security checks (x-ray and metal detector). In addition however, the system can contain a wireless card interface located at this security gate. As the passenger passes through this security portal into the secure gate area, the portal 15 can send an optional message to the card digitally marking it as to the fact that the passenger is now in the gate area 12 as well as entering the fact in the database. A similar portal without carry-on check 14 could be located at the aircraft doorway so that when the passenger actually enters the aircraft 13, the card could again be digitally marked indicating the passenger is actually aboard the aircraft. An optional positive identification could be made at this point with an optional second positive identification device 29 to assure that the correct person has boarded.

In addition, the wireless communication can be continued on into the aircraft if the craft is equipped with wireless communications capability. The aircraft's security system could thus also maintain satellite communication with the rest of the system at all times including when the aircraft is in flight.

The present invention allows tracking of the passenger from the non-secure part of the airport into the secure gate area, and finally onto the aircraft by various antennas 32 or other communications means located throughout the facility or airport. Upon arrival at a different airport, the present invention allows tracking of the passenger from the aircraft 13 into the secure gate area 12, on to customs/immigration, if an international flight, and out of that area to a baggage area or to another transfer aircraft, and either out of the airport or onto a second aircraft.

Figure 4B:
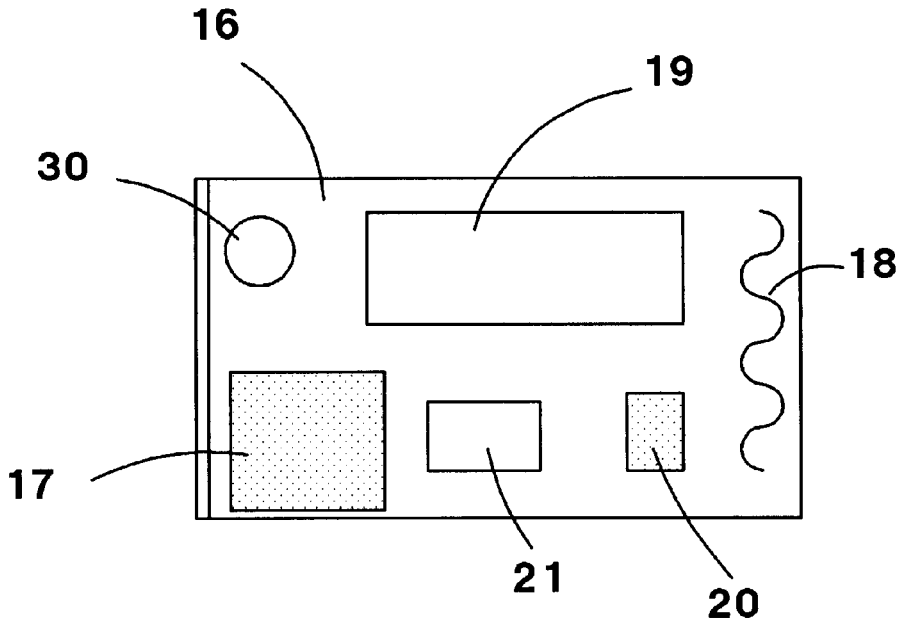
FIG. 4 shows a representative drawing of a possible card or carry device along with LED display and audible alarm.
Figure 4A:
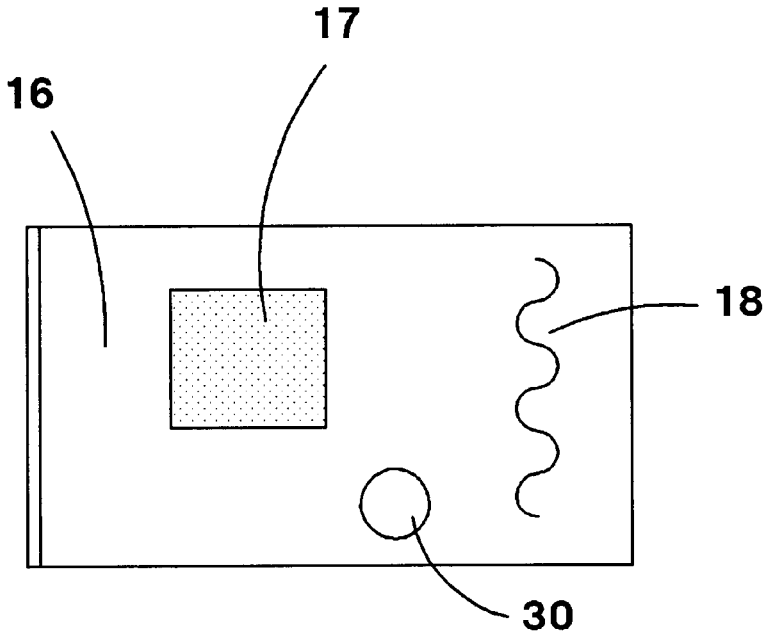

FIGS. 4A and 4B show replicas of a "smart" type card 16. The embodiment in FIG. 4A is a simple card used for identification only. This embodiment could contain a processor and wireless transponder 17 embedded in the card. An antenna 18 can also be embedded in the card as well as a battery 30. The processor can also contain optionally RAM or ROM memory. Various programs or processes can be used with the card 16. The processor can be a microprocessor or microcontroller or any other processor device. Memory can be internal or external to the processor.

FIG. 4B shows a more sophisticated version of an electronic card 16. Here, in addition to the features described in relation to the card shown in FIG. 4A, the card could contain a display 19, a microphone/speaker 20, a miniature mouse 21 and other features needed to transmit, receive, and/or display information such as email, flight schedules, internet, and messages of concern from the airline such as gate changes, etc., as well as stock prices, news headlines or stories, or any other type of information that might be of interest to the passenger. In addition, the advanced card of FIG. 4B could also be used to play various games using the mouse device 21. A different version could also contain a cellular telephone (not shown). The card device could also be a Personal Digital Assistant (PDA). In this case the device must, in addition, have the sophistication of various PDA units on the market. The card unit could also optionally contain a cellular telephone. Of course any electronic card unit could contain memory. At least 16 MB would be desirable; however, any amount of memory, including no memory, is within the scope of the present invention.

Tracking of the card 16 within the airport can always be accomplished using a series of local antennas within the building. Normal burst transponding techniques can be used. Any type of wireless method of handling multiple stations can be used including spread-spectrum, wi-fi, bluetooth wireless, or any other digital or analog wireless methods. Transmission between airport antennas and the card 16 can be radio frequency or optical, including infrared, continuous, packet, burst, or any other means using time-division multiplex, frequency division multiplex, code division multiplex, ATM, Wi-Fi, or any other communication method. Modulation can AM, FM, PM, using any type of PCM or data communications technique or combination of these methods including QAM and QPSK, or any other modulation technique. In addition error correcting codes and retransmission techniques can be used to assure data integrity. Any remote means of communicating with the card is within the scope of the present invention. It is also possible for the electronic card to communicate with satellites if necessary.

Figure 5:
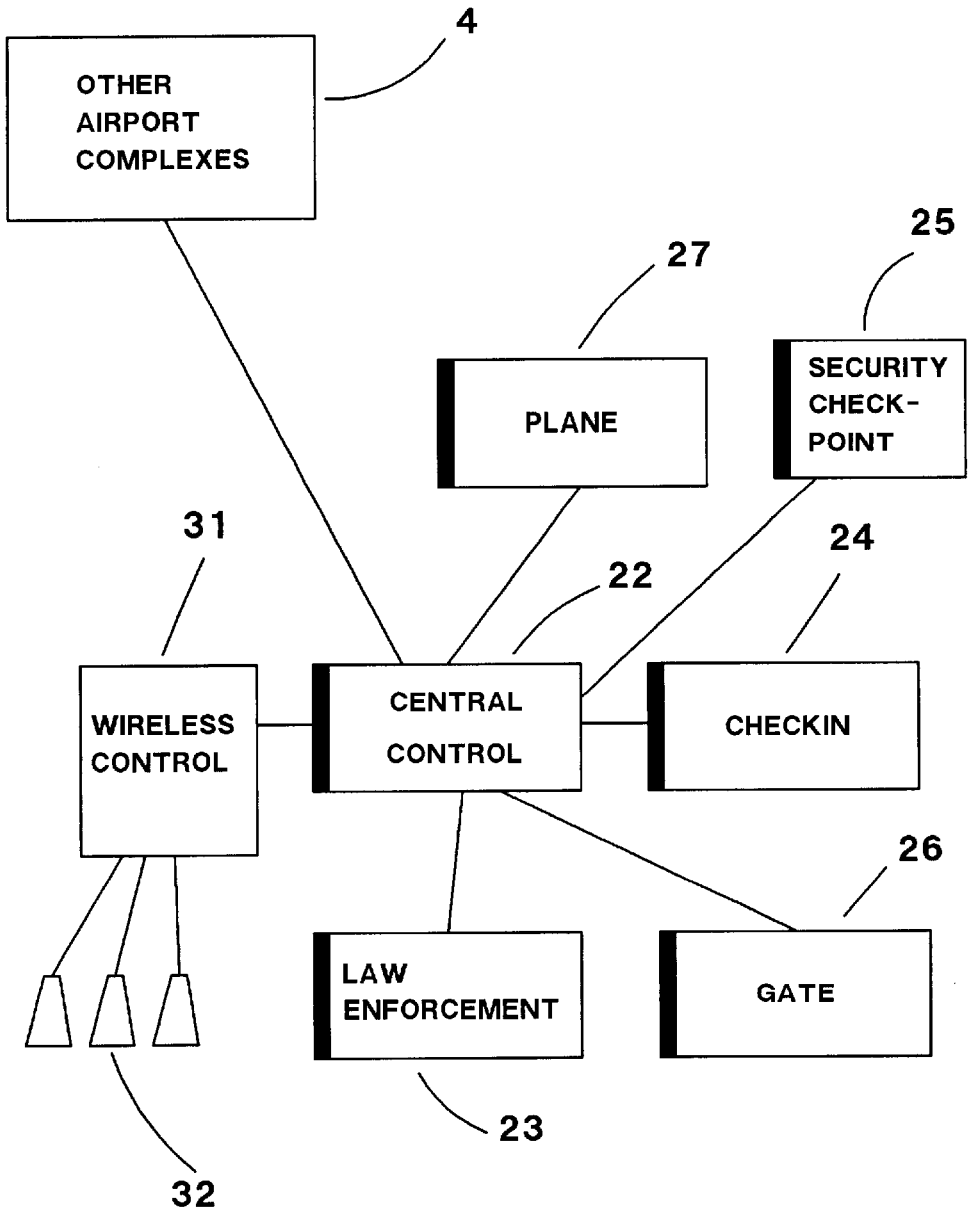
FIG. 5 shows a block diagram of the relationships between the card, check-in, and security/law enforcement data bases.

FIG. 5 shows the logical relationships between the various possible components of the invention. A central control and database 22 can be a mainframe, personal computer, or any other type of computer system. This central control can be connected by modem, LAN, WAN, internet, or any other communications means to law enforcement, immigration/customs and/or DMV data bases 23 for identification verification and determining if a given individual is of any interest to law enforcement officials. The central control 22 can also be connected by cable, LAN, WAN, modem, wireless, or by any other connection means to check-in points 24 where airline personnel check-in passengers, security check points 25, boarding gates 26, and other points in the airport including parked aircraft 27. In addition to the links shown, the central control point 22 for a given airport can be connected to control points for other airports 4 or to a master control point for a country or even the entire world. Communications can continue into the interior of aircraft, even aircraft in flight with satellite communications. The central control point 22 can be connected to a wireless communication system controller 3 within an airport or building. This wireless controller 31 is connected to a number of antennas 32 located throughout the airport or building.

Position location can be accomplished by using signal strength to determine the nearest antenna to the card in question, direction fixing by multiple antennas, or GPS techniques where a GPS receiver is incorporated into the card. No matter how position is determined, the present invention requires resolution to at least major location areas within an airport or building. In a building, it is necessary to know what floor a visitor or employee is on, and approximately where on that floor. The higher the position resolution, the better; however, the system can run with minimum position resolution as long as position is known well enough for security personnel to find a person in an airport or building within a reasonable time.

Figure 6:
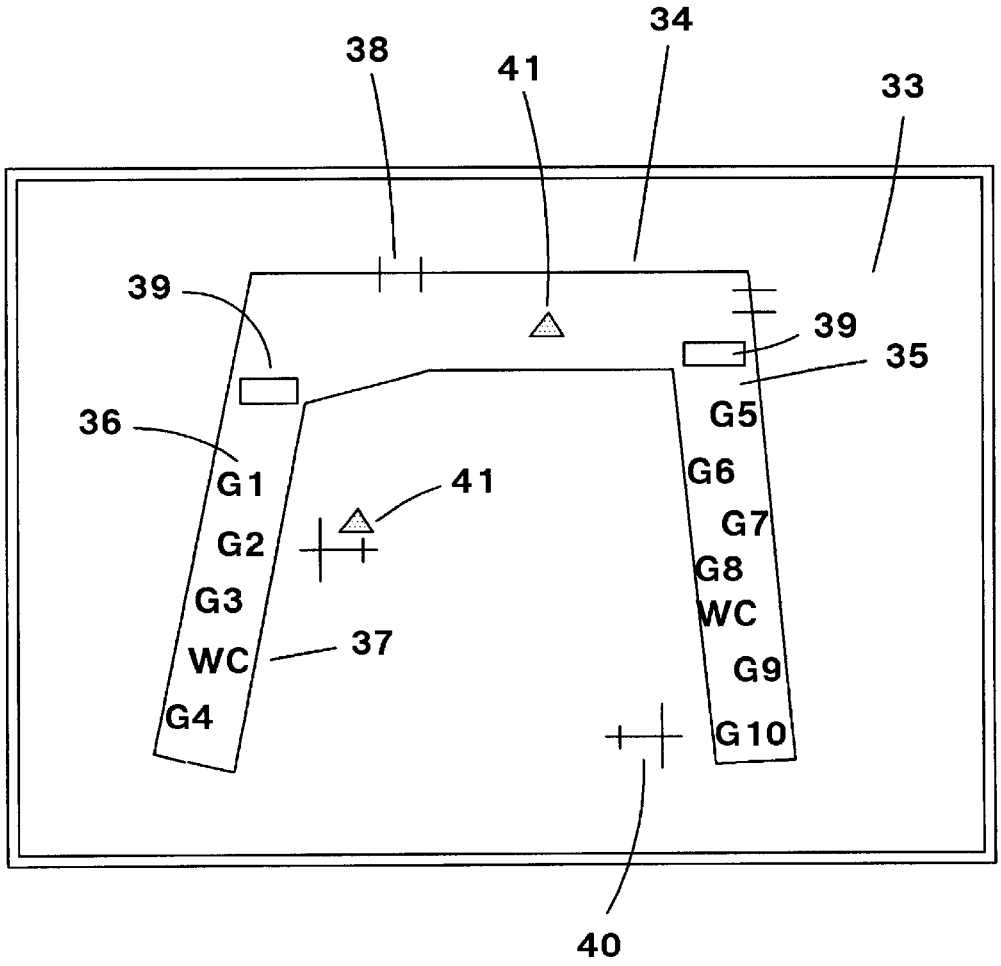
FIG. 6 shows an example of a possible tracking display used in a control room to track movements of passengers or visitors.

In the case where multiple airports or buildings are linked into a single system, passengers with cards can be tracked from airport to airport around the world from the time a passenger first enters an airport to the time the passenger leaves the airport system at a final destination, including tracking of passengers aboard aircraft in flight using satellite communication techniques. In addition, the system of the present invention can track airport or building employees, both full time and part time or temporary, and baggage if a card is also attached to baggage. FIG. 6 shows an embodiment of a display device that could be located in a control room and manned by security or airline personnel. It could also be located at a security control room of a commercial building. The display device can be a standard computer monitor or special display device. A screen 33 displays an outline of the airport or building 34. If there are multiple floors, individual floor plans can be brought up and changed for viewing. The display 33 shows secure gate areas 35 with aircraft 40 parked at some gates. The floor plan shows gates 36, passage-ways, and bathrooms 37 as well as all other rooms or spaces. Security check points 39 can be noted as well as building entrances and exits 38. Passengers or visitors of interest can be displayed 41 and tracked. The icon for a particular person being tracked could carry an identification box with relevant information about that person. In addition, different colors could be used to indicate the degree of interest. Special marks could signal whether that person was in a secure area or not. In short, the display can display any data of interest about a particular person in the building, including who they are and especially where they are.

It should be noted that the present invention could also be used to track baggage. An electronic card device could be attached to baggage, and the baggage could thus be tracked through the system just like a passenger. This type of baggage tracking would assure that a passenger's baggage was on the same plane as the passenger.

The illustrations and descriptions herein were presented for understanding of the present invention. It would be clear to one skilled in the art that many other embodiments and variations are possible which are within the scope of the present invention.

I claim:

1. A security system comprising:

a positive identification means yielding a positive identification of an individual;

a database;

a check means for checking said positive identification against said database for law enforcement interest;

a wireless electronic card means capable of being located within a building by wireless methods, said wireless electronic card means carried by said person within said building;

a law enforcement detention means for performing a stop of said person if said check means indicates law enforcement interest in said person, said wireless electronic card means locating said person within said building for said stop.

2. The security system of claim 1 wherein said positive identification means is a face features scan.

3. The security system of claim 1 wherein said positive identification means is a fingerprint scan.

4. The security system of claim 1 wherein said wireless means is bluetooth technology.

5. The security system of claim 1 wherein said wireless means is a wireless wide-area-network.

6. The security system of claim 1 wherein said wireless means is a wireless local-area-network.

7. A method of building personnel security management comprising the steps of:

acquiring physical positive identification data on each person entering building complex;

performing an identity verification by checking positive identification data acquired against stored identification data in at least one database;

notifying law enforcement officials upon identification of any person entering said building complex of law enforcement interest;

issuing each person entering said building complex a wireless identification unit, said wireless identification unit kept on said person while said person is in said building complex;

tracking a location of said wireless unit while said person is in said building complex.

8. The method of claim 7 wherein said building complex is an airport.

9. The method of claim 7 wherein said building complex is an office building.

10. The method of claim 7 wherein said wireless identification unit communicates via a wireless local-area-network.

11. The method of claim 7 wherein said wireless identification unit communicates via Bluetooth.

12. The method of claim 7 further comprising the step of comparing said person against said database a second time when said person exits said building complex.

13. The method of claim 7 wherein acquiring said positive identification data is by taking a fingerprint.

14. The method of claim 7 wherein acquiring said positive identification data is by face feature scan.

15. The method of claim 7 further comprising locating said wireless identification unit if said unit is removed from said person.

16. The method of claim 15 further comprising the step of notifying law enforcement officials when said wireless identification unit is determined to have been removed from said person.

17. The method of claim 7 further comprising the step of requiring said person to show a government generated ID card.

18. The method of claim 17 further comprising the step of notifying law enforcement officials when said government generated ID card does not match said positive identification data.

19. A method of security comprising the steps of taking positive identification data from a person entering a restricted area, comparing said positive identification data against at least one database, notifying an enforcement authority when said positive identification compared against said database indicates at least one of: said positive identification does not match a government issued ID card or said comparing of said positive identification against said database indicates law enforcement interest, and issuing said person a wireless unit said unit able to be tracked in said restricted area.

20. The method of claim 19 wherein said wireless unit reports a location to a central control point while in said restricted area.

21. The method of claim 19 wherein said wireless unit communicates via a wireless local-area-network.

22. The method of claim 19 wherein said wireless unit contains a transponder.

* * * * *